US008887610B2

(12) United States Patent
Kobayashi et al.

(10) Patent No.: US 8,887,610 B2
(45) Date of Patent: Nov. 18, 2014

(54) CAPSTAN DEVICE

(75) Inventors: Eiji Kobayashi, Yokkaichi (JP); Osamu Tamada, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 13/879,126

(22) PCT Filed: Jan. 12, 2012

(86) PCT No.: PCT/JP2012/050467

§ 371 (c)(1),
(2), (4) Date: Apr. 12, 2013

(87) PCT Pub. No.: WO2012/153545

PCT Pub. Date: Nov. 15, 2012

(65) Prior Publication Data

US 2013/0214079 A1 Aug. 22, 2013

(30) Foreign Application Priority Data

May 10, 2011 (JP) ..... 2011-105322

(51) Int. Cl.
*D04C 3/48* (2006.01)
*H01B 13/00* (2006.01)
*H01B 13/26* (2006.01)

(52) U.S. Cl.
CPC ..... *H01B 13/00* (2013.01); *H01B 13/2606* (2013.01)
USPC ..... 87/31

(58) Field of Classification Search
USPC ..... 87/31; 57/68; 242/354
See application file for complete search history.

(56) References Cited

U.S. PATENT DOCUMENTS 412,369 A * 10/1889 Drawbaugh ..... 87/31
1,322,590 A * 11/1919 Lewis ..... 87/31
1,920,224 A * 8/1933 Weaver ..... 242/364.2
1,958,098 A * 5/1934 Standish ..... 87/31
3,124,032 A * 3/1964 Webster et al. ..... 87/1
3,640,438 A * 2/1972 Morse et al. ..... 226/25

(Continued)

FOREIGN PATENT DOCUMENTS

JP A-06-150731 5/1994
JP A-11-061669 3/1999
JP A-2003-308744 10/2003
JP A-2004-311330 11/2004

OTHER PUBLICATIONS

Apr. 3, 2012 International Search Report issued in Application No. PCT/JP2012/050467.

*Primary Examiner* — Shaun R Hurley
(74) *Attorney, Agent, or Firm* — Oliff PLC

(57) ABSTRACT

A capstan device for taking up a braided wire in a braided wire manufacturing apparatus for braiding a plurality of wires to manufacture the braided wire. The capstan device includes a capstan roller having a tapered outer peripheral surface and provided with a flange portion on an end at a small diameter side thereof, and a guide member. The guide member has a first guide surface provided to be turned toward a large diameter side of the capstan roller in an axial direction of the capstan roller in a position on a larger diameter side than a portion having the smallest diameter in the tapered outer peripheral surface, and a second guide surface provided to be protruded from the first guide surface at an outer peripheral side of the tapered outer peripheral surface.

3 Claims, 6 Drawing Sheets

(56) References Cited

U.S. PATENT DOCUMENTS 3,653,295 A * 4/1972 Pintard ..... 87/1
4,026,525 A * 5/1977 Declercq ..... 254/333
5,501,386 A * 3/1996 Kobayashi ..... 226/190
2005/0115738 A1 6/2005 Yamaguchi et al.

* cited by examiner

CAPSTAN DEVICE

TECHNICAL FIELD

The present invention relates to a technique for taking up a braided wire.

BACKGROUND ART

Patent Document 1 discloses a technique for forming a shielding layer for an electric wire.

In the Patent Document 1, a shielding material to be sent out of a bobbin is cylindrically braided around an electric wire to be shielded and is pulled by means of a capstan, and is then fed into a synthetic resin extrusion molding machine.

PRIOR ART DOCUMENT

Patent Document

Patent Document 1: Japanese Patent Application Laid-Open No. 2004-311330

SUMMARY OF INVENTION

Problems to be Solved by the Invention

In a capstan device for taking up a wire, usually, the wire is wound around a capstan roller at plural times in order to cause sufficient take-up force to act on the wire. In this case, with the structure in which a shielding material is braided around an electric wire to be shielded as in the Patent Document 1, a sectional configuration is comparatively stable. Therefore, the wire can be wound around the capstan roller in an alignment state.

Depending on the uses of the shielded electric wire or the like, a braided wire which is braided cylindrically in an air core state is manufactured and an electric wire is inserted into the air core braided wire in some cases.

However, the air core braided wire takes an unstable sectional shape. For this reason, in the case in which the air core braided wire is wound around the capstan roller, it is hard to maintain an alignment state.

For this reason, there is a fear that a position in which a braided wire is formed by a shielding material and a position in which the capstan device takes up the braided wire might be unstable. When a relationship between both of the positions is unstable, there is a fear that a mesh might be ununiform to have a bad influence in respect of a shielding performance. In the case in which an end of the braided wire is caulked and fixed to a grounding ring member or the like, moreover, there might be caused deterioration in a fixing strength between both of them, increase in a contact resistance or the like.

Therefore, it is an object of the present invention to enable a mesh to be as uniform as possible when forming a braided wire.

Means for Solving the Problem

In order to solve the problems, a first aspect is directed to a capstan device for taking up a braided wire in a braided wire manufacturing apparatus for braiding a plurality of wires to manufacture the braided wire, the capstan device including a capstan roller having a tapered outer peripheral surface and provided with a flange portion on an end at a small diameter side thereof, and a guide member having a first guide surface provided to be turned toward a large diameter side of the capstan roller in an axial direction of the capstan roller in a position on a larger diameter side than a portion having the smallest diameter in the tapered outer peripheral surface, and a second guide surface provided to be protruded from the first guide surface at an outer peripheral side of the tapered outer peripheral surface.

A second aspect is directed to the capstan device in accordance with the first aspect, wherein the second guide surface is formed to have a quarter circular arc shape extending in an extending direction of the tapered outer peripheral surface.

A third aspect is directed to the capstan device in accordance with the first or second aspect, wherein the second guide surface is an arcuate peripheral surface formed to have an equal radius of curvature in the axial direction of the capstan roller.

Effect of the Invention

According to the capstan device in accordance with the first aspect, the braided wire is controlled to be moved toward the small diameter side of the tapered outer peripheral surface by the first guide surface, and at the same time, is guided by the second guide surface at the outer peripheral side of the tapered outer peripheral surface and then reaches the tapered outer peripheral surface. Then, the braided wire is wound around the tapered outer peripheral surface and is thus taken up. For this reason, the position in which the braided wire is started to be wound around the tapered outer peripheral surface becomes stable, and the position in which the braided wire is manufactured and the position in which the capstan device takes up the braided wire become stable. Consequently, the mesh of the braided wire thus manufactured can be as uniform as possible.

According to the second aspect, the braided wire can be guided to an opposite side to the braiding position for the braided wire by means of the second guide surface. Consequently, the position in which the braided wire is manufactured and the position in which the capstan device takes up the braided wire can be stabilized more greatly. Thus, a mesh of the braided wire thus manufactured can be made more uniform.

According to the third aspect, the second guide surface can easily be processed. Moreover, the braided wire can readily be provided around the second guide surface.

EMBODIMENT FOR CARRYING OUT THE INVENTION

A capstan device according to an embodiment will be described below.

Figure 1:
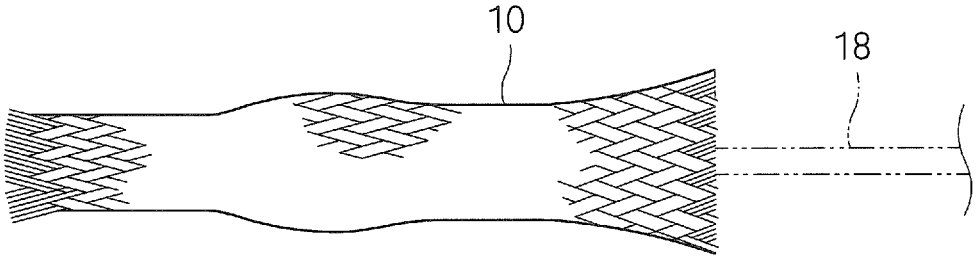
FIG. 1 is a schematic view showing a braided wire to be a take-up target.

FIG. 1 is a schematic view showing a braided wire 10 to be a take-up target. The braided wire 10 is formed by air-core cylindrically braiding a plurality of (for example, 44) conductive wires 12 which are wires. A copper wire, a copper alloy wire or the like is used for the conductive wire. The braided wire 10 can be expanded to enlarge a mesh. An electric wire 18 such as an electric power line is inserted into the braided wire 10 which is expanded, and the braided wire 10 thus covers the electric wire 18. Consequently, the braided wire 10 electromagnetically shields the electric wire 18. The braided wire 10 is used as a shielding material for covering the electric wire 18 for supplying power to a motor in an electric vehicle or the like, for example.

Figure 2:
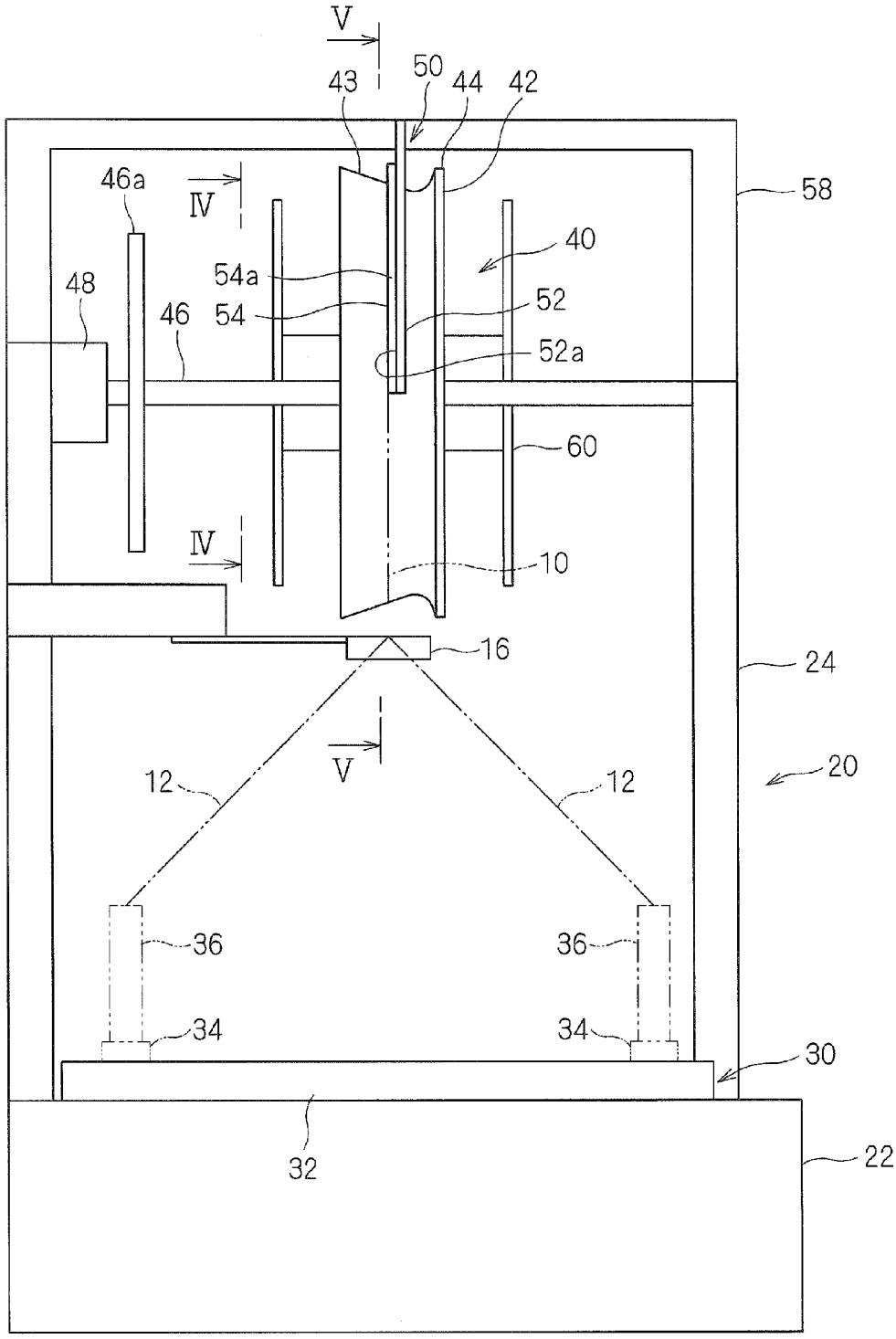
FIG. 2 is a front view showing a braided wire manufacturing apparatus in which a capstan device is incorporated.
Figure 3:
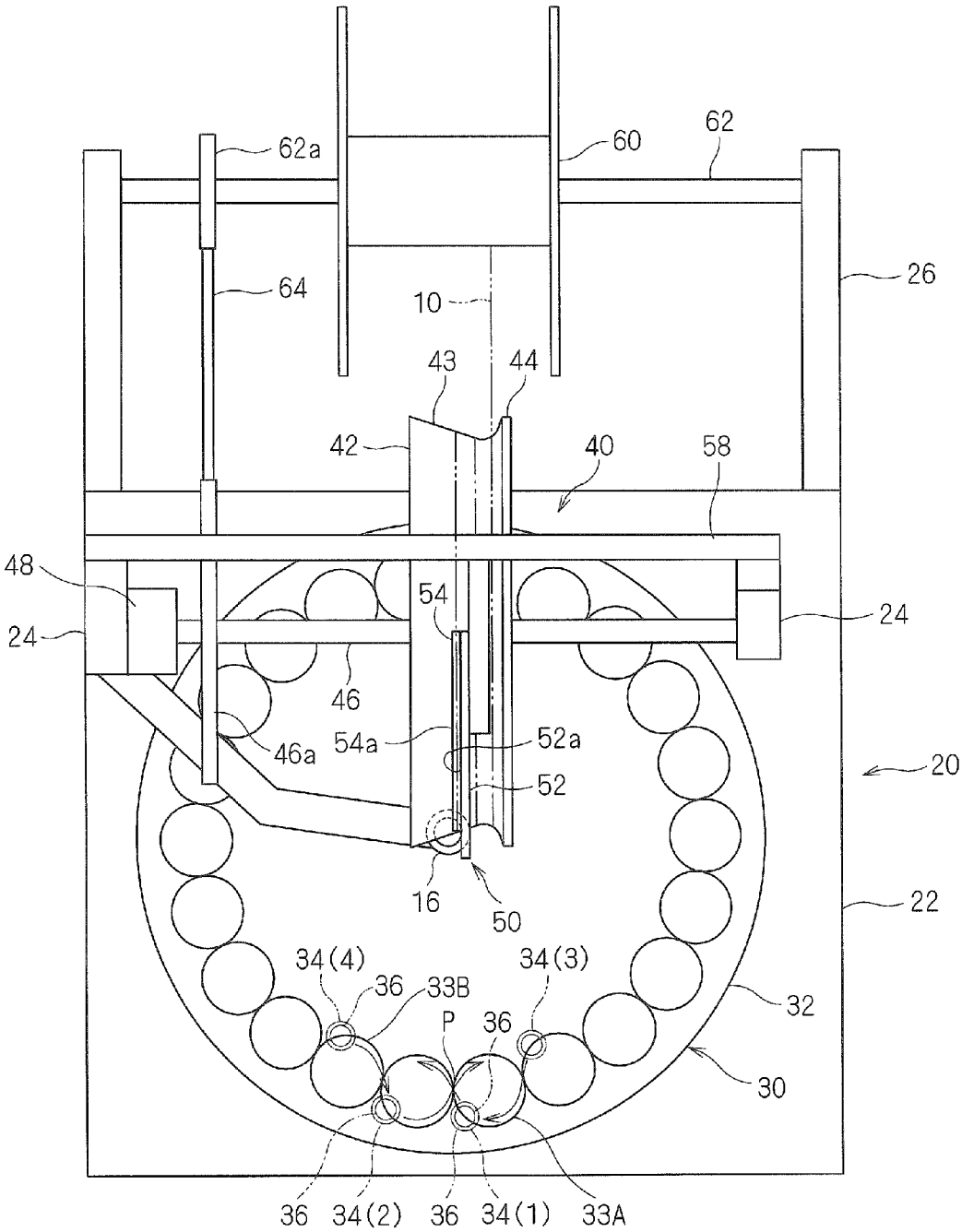
FIG. 3 is a plan view showing the braided wire manufacturing apparatus.
Figure 4:
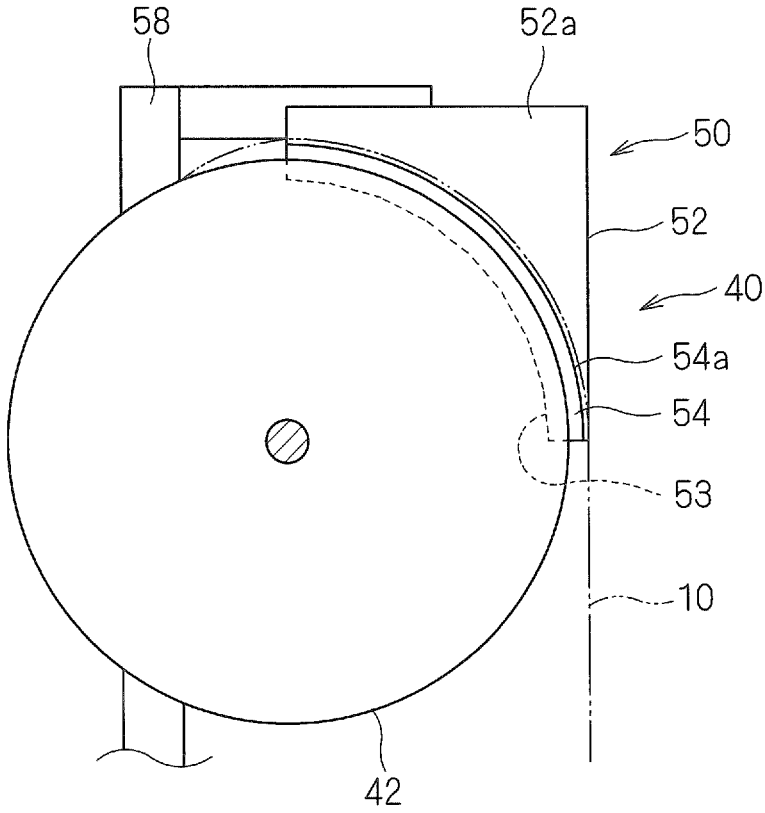
FIG. 4 is a sectional view showing the capstan device taken along an IV-IV line in FIG. 2.
Figure 5:
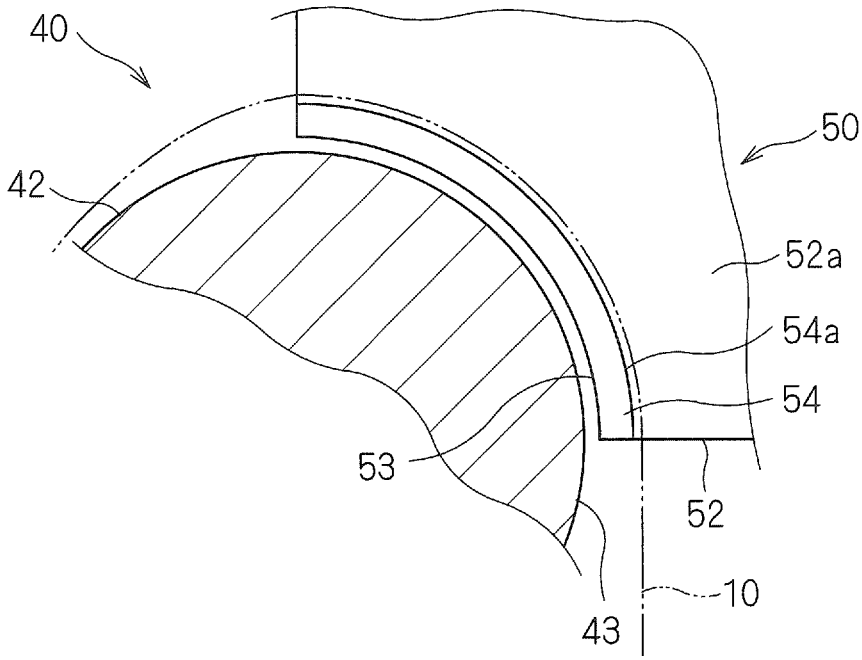
FIG. 5 is a partially sectional view showing the capstan device taken along a V-V line in FIG. 2.

FIG. 2 is a front view showing a braided wire manufacturing apparatus 20 in which a capstan device 40 is incorporated, and FIG. 3 is a plan view showing the braided wire manufacturing apparatus 20. FIG. 4 is a sectional view showing the capstan device 40 taken along an IV-IV line in FIG. 2, and FIG. 5 is a partially sectional view showing the capstan device 40 taken along a V-V line in FIG. 2.

The braided wire manufacturing apparatus 20 serves to braid the plurality of conductive wires 12 to manufacture the braided wire 10, and includes a wire supplying mechanism 30, the capstan device 40 and a take-up housing portion 60.

The wire supplying mechanism 30 is constituted to enable the plurality of conductive wires 12 to be fed out in such a manner that a cylindrical mesh can be formed. The wire supplying mechanism 30 includes a running base 32 provided on a device table 22, a plurality of running portions 34 provided to enable running over the running base 32, and bobbins 36 provided on the plurality of running portions 34 respectively. In order to distinguish the plurality of running portions 34, they are indicated as running portions 34(1), 34(2), 34(3) and 34(4) in the following description, FIG. 3 and the like in some cases.

The running base 32 is formed to have a disc shape and has two tracks 33A and 33B on an upper surface thereof. Each of the tracks 33A and 33B is formed as a track connected annularly in such a manner that a semi-arcuate portion draws a sine curve. Moreover, the two tracks 33A and 33B intersect with each other in a state in which a portion to be convexed toward an outer peripheral side and a portion to be concaved toward an inner peripheral side are coincident with each other (a shift is caused by a half cycle with respect to the sine curve).

The running portion 34 is constituted to enable the bobbin 36 winding and accommodating the conductive wire 12 to be supported rotatably. The conductive wire 12 sent out of the bobbin 36 is braided into a cylindrical net by the running operation of the running portion 34, and at the same time, is taken up by the capstan device 40.

In other words, a half number of the plurality of running portions 34 are provided to enable the running operation along the track 33A, and a residual half number of the plurality of running portions 34 are provided to enable the running operation along the track 33B. A running driving mechanism using a motor, a running belt and the like is incorporated in the running base 32, and the running portion 34 is driven to run along the respective tracks 33A and 33B by means of the running driving mechanism. The plurality of running portions 34 are driven to run along the track 33A at an interval in a rotating direction at one of sides around the running base 32, and the running portions 34 are driven to run along the track 33B at an interval in a rotating direction at the other side around the running base 32. In the respective tracks 33A and 33B, the running portions 34 run with rotation in opposite directions to each other while mutually changing positions of inner and outer peripheries. With reference to FIG. 3, explanation will be given by taking note of a single point P where the tracks 33A and 33B intersect with each other. The running portion 34(1) to run along the track 33A passes through the point P from an outer peripheral side toward an inner peripheral side in a clockwise direction. Then, the running portion 34(2) running along the track 33B then passes through the point P from the outer peripheral side toward the inner peripheral side in a counterclockwise direction. Thereafter, the running portion 34(3) running along the track 33A passes through the point P from the outer peripheral side toward the inner peripheral side in the clockwise direction. Subsequently, the running portion 34(4) running along the track 33B further passes through the point P from the outer peripheral side toward the inner peripheral side in the counterclockwise direction. Consequently, the conductive wire 12 to be sent out of the bobbin 36 supported on the running portion 34 running along the track 33A and the conductive wire 12 to be sent out of the bobbin 36 supported on the running portion 34 running along the track 33B are alternately provided to the inner peripheral side and the outer peripheral side, and at the same time, are supplied from the outer peripheral side around a predetermined axis, and are gathered on central axes of the tracks 33A and 33B and are thus braided into a cylindrical net configuration.

An annular disconnection detecting portion 16 is provided in a gathering portion in which the plurality of conductive wires 12 are to be braided. When the conductive wire 12 is disconnected in the middle and thus comes in contact with the disconnection detecting portion 16, the disconnection of the conductive wire 12 is detected by the contact.

The braided wire 10 obtained by the braided wire manufacturing apparatus 20 is taken up by the capstan device 40 and is thus wound and accommodated in the take-up housing portion 60.

In other words, the capstan device 40 is provided above the wire supplying mechanism 30, and furthermore, the take-up housing portion 60 is provided on a side of the capstan device 40.

The capstan device 40 is constituted to take up the braided wire 10 in such a manner that the conductive wire 12 is continuously pulled out of the bobbin 36 and to enable the braided wire 10 taken up to be fed to the take-up housing portion 60.

The capstan device 40 includes a capstan roller 42 and a guide member 50.

The capstan roller 42 has a disc shape as a whole and includes a tapered outer peripheral surface 43 having a diameter reduced sequentially from one end side toward the other end side, and furthermore, has an end at a small diameter side in which a flange portion 44 protruded toward the outer peripheral side is formed. Although there is formed a portion having a diameter increased slightly toward the flange portion 44 from a portion having the smallest diameter in the tapered outer peripheral surface 43, this is not indispensable.

The capstan roller 42 is supported rotatably over the running base 32 by means of a strut 24 provided on the device table 22. In the support state, a rotating axis of the capstan roller 42 is provided in a horizontal direction and is orthogonal to a vertical direction to be a take-up direction of the braided wire 10. Moreover, extending lines of central axes of the tracks 33A and 33B come in contact with the tapered outer peripheral surface 43 in a position on a larger diameter side than the portion having the smallest diameter in the tapered outer peripheral surface 43 in an axial direction of the capstan roller 42. Consequently, the cylindrical braided wire 10 is exactly pulled in a just upward direction and is taken up with a portion on the large diameter side in the tapered outer peripheral surface 43 set to be a take-up starting point.

Furthermore, a rotational driving mechanism 48 such as a motor is provided on one of ends of a rotating shaft portion 46 of the capstan roller 42. The capstan roller 42 is rotationally driven by the rotational driving mechanism 48 in such a direction as to take up the braided wire 10.

In the braided wire manufacturing apparatus 20, it is also possible to incorporate another capstan for further applying a tension to the braided wire 10, an accumulator for absorbing an extra length, or the like.

The take-up housing portion 60 is formed to have a reel shape which can wind and accommodate the braided wire 10, and is rotatably supported by a support frame 26 in a side position of the capstan roller 42. Moreover, an annular belt 64 is wound around a pulley 46*a* attached to the rotating shaft portion 46 of the capstan roller 42 and a pulley 62*a* attached to a rotating shaft portion 62 of the take-up housing portion 60, and the rotation of the rotating shaft portion 46 is transmitted to the rotating shaft portion 62 through the annular belt 64. Consequently, the take-up housing portion 60 is rotated synchronously with the capstan roller 42.

When the capstan roller 42 and the take-up housing portion 60 are rotated by the rotational driving mechanism 48, the braided wire 10 is taken up by the capstan roller 42, and at the same time, is fed to the take-up housing portion 60 and is thus wound and accommodated in the take-up housing portion 60.

The guide member 50 is a member supported in a position on the outer peripheral side of the capstan roller 42 by a support bracket 58, and has a first guide portion 52 and a second guide portion 54.

The first guide portion 52 is formed to have a plate shape and a part thereof has an arcuate edge portion 53 formed in a circumferential direction of the tapered outer peripheral surface 43. The arcuate edge portion 53 is formed to have a quarter circular arc shape extending in the circumferential direction of the tapered outer peripheral surface 43. The first guide portion 52 is supported in such a posture that the arcuate edge portion 53 is provided on an outer peripheral side of the quarter circular arc portion to be an uppermost part from a portion coming in contact with the extending lines of the central axes of the tracks 33A and 33B in the tapered outer peripheral surface 43, and a main surface of the first guide portion 52 is caused to be orthogonal to the rotating axis of the capstan roller 42. In this posture, furthermore, a first guide surface 52*a* turned toward the large diameter side of the tapered outer peripheral surface 43 in the first guide portion 52 is provided in a position on the larger diameter side than the portion having the smallest diameter in the tapered outer peripheral surface 43 (for example, a middle position between the portion having the smallest diameter of the tapered outer peripheral surface 43 and the portion having the largest diameter thereof, or the like) in a direction of the rotating axis of the capstan roller 42.

The second guide portion 54 is provided to be protruded from the first guide surface 52*a* at the outer peripheral side of the tapered outer peripheral surface 43. A surface on the outer peripheral side of the second guide portion 54 serves as a second guide surface 54*a* protruded from the first guide surface 52*a* at the outer peripheral side of the tapered outer peripheral surface 43.

More specifically, the second guide portion 54 is formed into a long member formed to have a quarter circular arc shape in the same manner as the arcuate edge portion 53. The second guide surface 54*a* to be a surface on the outer peripheral side of the second guide portion 54 is formed to have a quarter circular arc shape which extends in the circumferential direction of the tapered outer peripheral surface 43. A radius of curvature of the second guide surface 54*a* may be larger than that of the tapered outer peripheral surface 43. Also in the present embodiment, the radius of curvature of the second guide surface 54*a* is slightly larger than that of the tapered outer peripheral surface 43.

In the direction of the rotating axis of the capstan roller 42, moreover, a thickness dimension of the second guide portion 54 is set to be larger than a width dimension of the braided wire 10 which is brought into a flat state. Consequently, the braided wire 10 provided along the second guide surface 54*a* is not protruded from the second guide surface 54*a* but is guided along the second guide surface 54*a*.

Moreover, the second guide surface 54*a* is formed to have an equal radius of curvature in the direction of the rotating axis of the capstan roller 42. In other words, the second guide surface 54*a* is formed to be a flat surface in a direction along the direction of the rotating axis of the capstan roller 42. As a matter of course, the second guide surface 54*a* may be formed to have a taper shape in which the radius of curvature is gradually reduced toward the first guide surface 52*a* side or may be formed to have a groove shape in which the radius of curvature is the smallest in a middle portion in a thickness direction thereof.

An operation of the capstan device 40 will be described.

First of all, the conductive wire 12 sent out of each bobbin 36 in the braided wire manufacturing apparatus 20 is gathered in the extension of the central axes of the tracks 33A and 33B, is braided into a cylindrical net, is taken up by the capstan device 40, and is thus fed toward the take-up housing portion 60.

When the braided wire 10 is to be fed toward the capstan roller 42, the braided wire 10 is guided by the guide member 50 above the capstan roller 42 (that is, a portion at an opposite side to the wire supplying mechanism 30) from the side of the capstan roller 42.

The guide member 50 causes the movement of the braided wire 10 toward the small diameter side of the tapered outer peripheral surface 43 to be controlled by the first guide surface 52*a*, and at the same time, the braided wire 10 is guided by the second guide surface 54*a* at the outer peripheral side of the tapered outer peripheral surface 43 and thus reaches the tapered outer peripheral surface 43. For this reason, the braided wire 10 is guided to reach the portion on the larger diameter side than the portion having the smallest diameter in the tapered outer peripheral surface 43 (see FIG. 5).

The braided wire 10 reaching the tapered outer peripheral surface 43 is wound at plural times (for example, twice) in a region reaching the flange portion 44 from the reached portion in the tapered outer peripheral surface 43, and is pulled out of the portion wound around the flange portion 44 and is thus led to the take-up housing portion 60. The braided wire 10 is wound around the tapered outer peripheral surface 43 at plural times so that a slip of the tapered outer peripheral surface 43 and the braided wire 10 is suppressed and the rotational driving force of the capstan roller 42 is transmitted more reliably as a force for taking up the braided wire 10. When the braided wire 10 is to be wound around the tapered outer peripheral surface 43, it is spirally wound in such a manner that respective revolving portions of the braided wire 10 do not interfere with each other.

Figure 6:
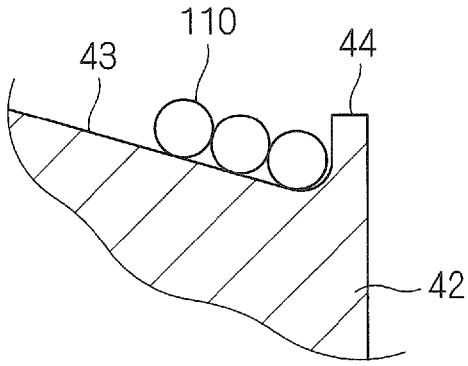
FIG. 6 is an explanatory view showing a state in which a wire is wound around a capstan roller.

There will be assumed the case in which the braided wire 10 is not hollow, that is, a wire 110 capable of maintaining a circular sectional shape is wound around the capstan roller 42 at plural times. In this case, as shown FIG. 6, the wire 110 itself does not lose a shape when the wire 110 is densely wound around the capstan roller 42 spirally in close contact with the flange portion 44. Therefore, the winding state can be maintained. Therefore, a take-up starting position in which the braided wire 10 is to be taken up by the capstan roller 42 is comparatively stable.

Figure 7:
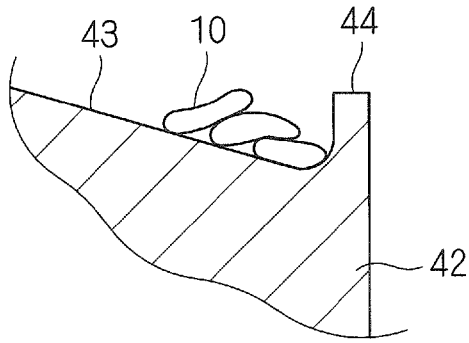
FIG. 7 is an explanatory view showing the state in which the wire is wound around the capstan roller.

On the other hand, there is assumed the case of the hollow braided wire 10 without the guide member 50 provided. In this case, when the braided wire 10 is wound around the capstan roller 42 spirally and densely, the braided wire 10 is moved to be inclined toward the small diameter side while it is deformed into a flat shape and the braided wires 10 for each revolution partially overlap with each other as shown in FIG. 7. For this reason, the take-up starting position in which the braided wire 10 is wound around the capstan roller 42 fluctuates depending on the overlapping state of the braided wires 10 for each revolution and becomes unstable. Therefore, the gathering position of the plurality of conductive wires 12 deflects around the central axes of the tracks 33A and 33B. Consequently, a way for braiding the plurality of conductive wires 12 is made ununiform so that a mesh is also caused to be uneven.

Figure 8:
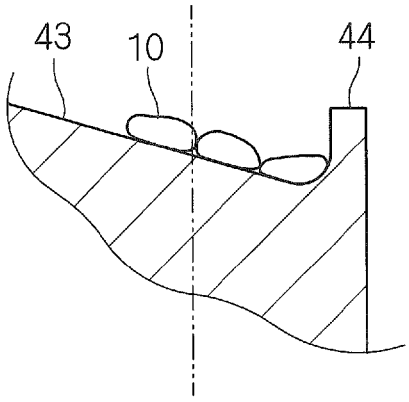
FIG. 8 is an explanatory view showing the state in which the wire is wound around the capstan roller.

On the other hand, when the braided wire 10 is guided by the guide member 50 and is thus fed to the capstan roller 42 as in the present embodiment, a position in which the braided wire 10 reaches the tapered outer peripheral surface 43 is stabilized in a certain position at the larger diameter side than the portion having the smallest diameter in the tapered outer peripheral surface 43 as shown in FIG. 8. Moreover, the take-up starting position in which the braided wire 10 is taken up by the tapered outer peripheral surface 43 is comparatively stable. Therefore, a manner for winding the braided wire 10 around the tapered outer peripheral surface 43 is also stabilized comparatively.

According to the capstan device 40 having the structure described above, the braided wire 10 is guided by the second guide surface 54*a* at the outer peripheral side of the tapered outer peripheral surface 43 while the movement toward the small diameter side of the tapered outer peripheral surface 43 is controlled by the first guide surface 52*a*, and thus reaches the tapered outer peripheral surface 43. Then, the braided wire 10 is wound and taken up by the tapered outer peripheral surface 43. For this reason, there is stabilized the position in which the braided wire 10 is started to be wound around the tapered outer peripheral surface 43. Consequently, there are stabilized the position in which the conductive wires 12 are gathered and braided into the braided wire 10 and the position in which the capstan device 40 takes up the braided wire 10. Thus, it is possible to cause the mesh of the braided wire 10 to be as uniform as possible. Consequently, a shielding performance of the braided wire 10 can be excellent. In the case in which the end of the braided wire 10 is to be caulked and fixed into a ground ring member or the like, moreover, a fixing strength between both of them can be excellent and a contact resistance can also be reduced stably.

Furthermore, the braided wire 10 can be guided to the opposite side to the braiding position by means of the second guide surface 54*a* formed into the quarter circular arc shape. By stabilizing, more greatly, the position in which the braided wire 10 is manufactured and the position in which the capstan device 40 takes up the braided wire, consequently, it is possible to cause the mesh of the braided wire thus manufactured to be more uniform.

When the capstan roller 42 takes up the braided wire 10, particularly, the greatest force for pulling the braided wire 10 acts at the opposite side (that is, an uppermost position) of the wire supplying mechanism 30 in the capstan roller 42. When the great force for pulling the braided wire 10 by the tapered outer peripheral surface 43 acts, then, the winding configuration of the braided wire 10 around the tapered outer peripheral surface 43 is apt to collapse (see FIG. 7). Therefore, the braided wire 10 is guided to the opposite side to the braiding position by the second guide surface 54*a* formed to have the quarter circular arc shape, so that the winding configuration of the braided wire 10 around the tapered outer peripheral surface 43 collapses with difficulty. Consequently, it is possible to smoothly take up the braided wire 10 by means of the capstan roller 42.

Moreover, the second guide surface 54*a* is the arcuate peripheral surface formed to have an equal radius of curvature in the axial direction of the capstan roller 42. Therefore, the second guide surface 54*a* can easily be processed. Moreover, it is possible to readily carry out a work for providing the braided wire 10 around the second guide surface 54*a*. Since the braided wire 10 wound around the tapered outer peripheral surface 43 tends to be moved toward the small diameter side, it is brought to the first guide surface 52*a* side. Even if the second guide surface Ma takes the shape described above, therefore, the braided wire 10 is guided by the second guide surface 54*a* without drop-out.

The braided wire manufacturing apparatus 20 described in the present embodiment can also manufacture an electric wire having a shield layer formed on an outer periphery by providing a conductive wire with covering or the like on a center when manufacturing the braided wire 10 from the plurality of conductive wires 12. In that case, the guide member 50 may be used exactly or removed.

While the invention has been shown and described in detail, the foregoing description is in all aspects illustrative and not restrictive. It is therefore understood that numerous modifications and variations can be devised without departing from the scope of the invention.

The invention claimed is:

1. A capstan device for taking up a braided wire in a braided wire manufacturing apparatus for braiding a plurality of wires to manufacture said braided wire, comprising:

a capstan roller having a tapered outer peripheral surface and provided with a flange portion on an end at a small diameter side thereof; and a guide member having a first guide surface provided to be turned toward a large diameter side of said capstan roller in an axial direction of said capstan roller in a position on a larger diameter side than a portion having the smallest diameter in said tapered outer peripheral surface, and a second guide surface provided to be protruded from said first guide surface at an outer peripheral side of said tapered outer peripheral surface, the guide member causing movement of said braided wire toward said small diameter side of said tapered outer peripheral surface to be controlled by said first guide surface and at the same time to be guided by said second guide surface to reach said tapered outer peripheral surface.

2. A capstan device for taking up a braided wire in a braided wire manufacturing apparatus for braiding a plurality of wires to manufacture said braided wire, comprising:

a capstan roller having a tapered outer peripheral surface and provided with a flange portion on an end at a small diameter side thereof; and a guide member having a first guide surface provided to be turned toward a large diameter side of said capstan roller in an axial direction of said capstan roller in a position on a larger diameter side than a portion having the smallest diameter in said tapered outer peripheral surface, and a second guide surface provided to be protruded from said first guide surface at an outer peripheral side of said tapered outer peripheral surface, wherein said second guide surface is formed to have a quarter circular arc shape extending in an extending direction of said tapered outer peripheral surface.

3. A capstan device for taking up a braided wire in a braided wire manufacturing apparatus for braiding a plurality of wires to manufacture said braided wire, comprising:

a capstan roller having a tapered outer peripheral surface and provided with a flange portion on an end at a small diameter side thereof; and a guide member having a first guide surface provided to be turned toward a large diameter side of said capstan roller in an axial direction of said capstan roller in a position on a larger diameter side than a portion having the smallest diameter in said tapered outer peripheral surface, and a second guide surface provided to be protruded from said first guide surface at an outer peripheral side of said tapered outer peripheral surface, wherein said second guide surface is an arcuate peripheral surface formed to have an equal radius of curvature in said axial direction of said capstan roller.

* * * * *